US006615734B2

(12) United States Patent
Koch et al.

(10) Patent No.: US 6,615,734 B2
(45) Date of Patent: Sep. 9, 2003

(54) MUNITION ARTICLE WITH ANTENNA FOR SATELLITE NAVIGATION

(75) Inventors: Volker Koch, Ruckersdorf (DE); Martin Hertel, Lauf (DE); Werner Wiesbeck, Keltern (DE); Eberhard Gschwendtner, Karlsruhe (DE)

(73) Assignee: Diehl Munitionssysteme GmbH & Co. KG, Röthenbach (DE)

( * ) Notice: Subject to any disclaimer, the term of this patent is extended or adjusted under 35 U.S.C. 154(b) by 0 days.

(21) Appl. No.: 09/951,244

(22) Filed: Sep. 13, 2001

(65) Prior Publication Data

US 2002/0029716 A1 Mar. 14, 2002

(30) Foreign Application Priority Data

Sep. 14, 2000 (DE) ..... 100 45 452

(51) Int. Cl.[7] ..... F42G 13/02; F41G 7/00

(52) U.S. Cl. ..... 102/213; 102/214; 244/3.14; 244/3.15

(58) Field of Search ..... 102/213, 214; 244/3.14, 3.15

(56) References Cited

U.S. PATENT DOCUMENTS 4,387,391 A * 6/1983 Hecker ..... 102/213 X
5,507,452 A * 4/1996 Mayersak ..... 244/3.15
6,079,333 A * 6/2000 Manning ..... 102/214 X
6,098,547 A * 8/2000 West ..... 244/3.14 X
6,237,496 B1 * 5/2001 Abbott ..... 244/3.14 X
6,254,031 B1 * 7/2001 Mayersak ..... 244/3.22
6,307,514 B1 * 10/2001 West ..... 244/3.14 X
6,345,784 B1 * 2/2002 Shnaps ..... 244/3.15

FOREIGN PATENT DOCUMENTS

DE 197 18 947 A1 11/1998
DE 197 40 888 C2 3/1999
DE 198 24 288 A1 12/1999
WO WO 99/02936 1/1999

* cited by examiner

*Primary Examiner*—Peter A. Nelson
(74) *Attorney, Agent, or Firm*—Scully, Scott, Murphy & Presser

(57) ABSTRACT

A munition article is to be provided with an antenna which, by virtue of a characteristic which is uniform all around, permits interference-free reception of items of satellite navigation information, even if in the manner of an artillery projectile it is fired with spin along an elongate ballistic trajectory, so that a tail antenna with a spherical characteristic does not allow the expectation of good reception factors in relation to navigation satellites which are as high as possible above the horizon. Therefore the tip (10) of the fuse tip (11) of the projectile is equipped with a dipole satellite antenna which faces in the direction of flight. Connected to the dipole (13) which is arranged concentrically with respect to the longitudinal axis (14) of the projectile are symmetrically disposed conductor portions (15) which rest with a close fit in recesses (19) in the ballistic cap (12).

8 Claims, 1 Drawing Sheet

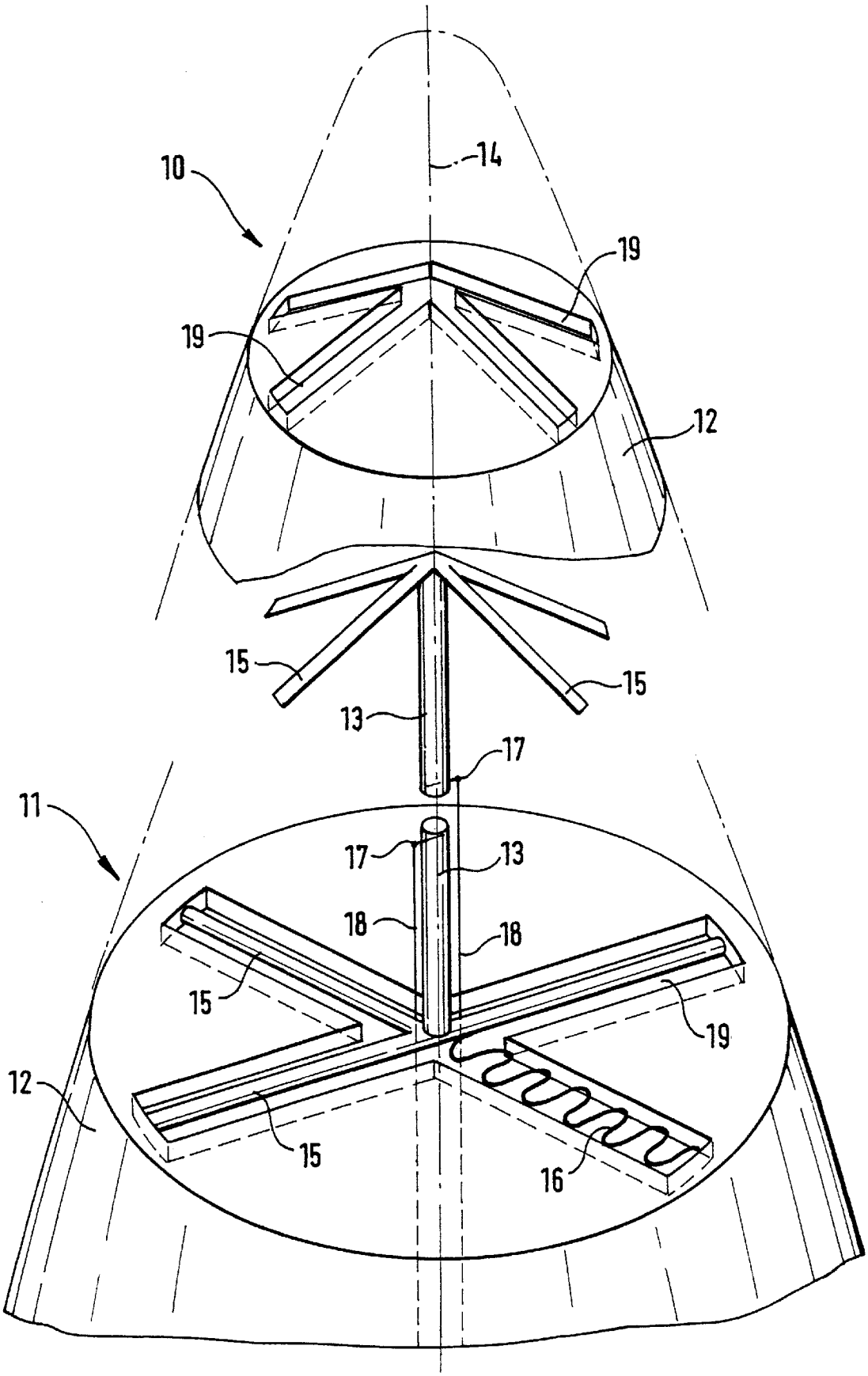
10
14
19
19
12
15
15
13
17
11
17
13
18
18
15
19
12
15
16

MUNITION ARTICLE WITH ANTENNA FOR SATELLITE NAVIGATION

BACKGROUND OF THE INVENTION

1. Field of the Invention

The invention concerns a munition article which is equipped with a satellite antenna.

2. Discussion of the Prior Art

A munition article of that kind is known from WO 99/02936 A2 in the form of a droppable bomb with sandwich-like or patch-like satellite antenna arranged in the centre of its tail. During the dropping movement into the target area the spherical antenna characteristic thereof maintains contact with navigation satellites which are above the horizon, in order to increase the bomb hit accuracy by means of final phase control, more specifically by comparison between the target point which is predetermined in terms of co-ordinates and the geodetic actual position of the munition article.

Such an antenna configuration is however unsuitable for munition articles in the form for example of artillery shells. For, during the major part of the extended ballistic flight, the antenna directional characteristic which is oriented rearwardly from the tail antenna substantially symmetrically with respect to the longitudinal axis of the projectile would be directed approximately to the horizon, and initially even therebelow, and only slightly thereabove after the apogee. As a result there is a rather low level of probability of being able to receive a plurality of navigation satellites simultaneously with a sufficient level of freedom from interference for rapid and precise trajectory point determination, for the purposes of trajectory correction. Even the incorporation of such a patch antenna into the tip of the projectile would be unsatisfactory because its spherical characteristic which would then be oriented coaxially forwardly would be directed markedly above the horizon only in the very first phase of the ballistic trajectory, in order to be able to detect a plurality of satellites in an appropriate configuration; while the tip, after passing through the apogee, is even directed towards the ground and with such an antenna it would then be possible at best to pick up the very interference-afflicted ground reflections of the signals from navigation satellites, the processing of which sufficiently quickly results in usable items of navigation information, if at all, only by way of considerable signal processing complication and involvement.

Furthermore, in the case of a munition article in the form of an item of artillery munition, in view of the antenna characteristic which is not ideally spherical in practice, the problem of stabilisation rotation arises. For, with an antenna characteristic which is not circular in cross-section, the consequence of the spin which occurs upon launch from a rifled barrel is that the received satellite signals are modulated in dependence on rotation, and that severely adversely affects evaluation of the signals from a plurality of satellites in immediate succession, which signals are to be compared together in rigid phase relationship in themselves for positional determination purposes.

SUMMARY OF THE INVENTION

In consideration of those factors the object of the present invention is therefore that of providing a munition article which is fired in the manner of an artillery projectile along a substantially horizontally extended trajectory with an antenna which has an appropriate directional characteristic for the reception of items of satellite navigation information.

In accordance with the invention that object is attained in that an exposed dipole antenna is arranged in the fuse tip of a projectile under a ballistic cap in such a manner whereby the axis of the dipole antenna coincided concentrically with the longitudinal axis of the projectile.

In accordance therewith disposed in the fuse tip of a projectile is a dipole which faces in the direction of flight and which is protectively enclosed by a ballistic cap. The orientation of the exposed dipole axis in the direction of flight guarantees an omnidirectional characteristic with a negligible variation in gain over the rotary angle which is given by the spin of the projectile. The fact that the longitudinal dipole axis concentrically coincides with the longitudinal axis of the projectile provides that the received signal is not modulated in dependence on rotation. The preferred working range of the linearly polarised dipole antenna corresponds to the frequency range of GPS-frequencies. In that case the working range of the dipole antenna is distinguished by the resonance frequency which is established by the zero-passage of the imaginary part of the input impedance in the range of the GPS-frequencies. In order to shorten the dipole length which is required for that purpose to the space available in the projectile, the dipole is equipped with top-loading capacitances which extend the effective length of the dipole by receiving the current. The top-loading capacitances comprise electrically conductive material such as for example metal surfaces or wires. Those conductor portions are arranged rotationally symmetrically about the longitudinal axis of the dipole, whereby the omnidirectional characteristic is guaranteed, and connected to the mutually opposite dipole ends. The conventional dipole radiating device has a half-value width or lobe width of the directional pattern of 78°. By virtue of the required reduction in the length of the dipole its half-value width moves towards 90°, which corresponds to the maximum possible half-value width of the Hertzian dipole which acts as the limit case of the shortened antenna. If the −10 dB width of the Hertzian dipole is set as the limit case, that affords a space coverage of 142°, whereby a large part of the region of space is covered. Narrow regions of space in the direction of flight and in opposite relationship to the direction of flight are not embraced. The conductor portions are inclined at the front end of the dipole towards the axis of the dipole so that in that way they can be fitted into the aerodynamically shaped ballistic cap. At the inside of the ballistic cap which preferably comprises plastic material, it is possible to provide openings and recesses which are of dimensions and in arrangements corresponding to the conductor portions secured to the axis of the dipole. The dipole or the conductor portions are at least partially positively lockingly fitted into that opening or recess.

In a further embodiment the dipole is let into a dielectric with a high dielectric constant, thereby also permitting a reduction in the dipole to the space available in the projectile and guaranteeing a frequency range corresponding to the GPS-frequencies.

Additional developments and further features and advantages of the invention will be apparent from the further claims and from the description hereinafter of a preferred embodiment of the structure according to the invention which is shown diagrammatically and not entirely true to scale and in greatly abstracted form, being restricted to what is essential. This structure affords the advantage that it can be implemented in the fuse tip which is usually removable from an artillery projectile, and therefore can also be subsequently applied to a standard projectile, without having to intervene in the load-bearing structure of the projectile case itself for providing the dipole antenna.

BRIEF DESCRIPTION OF THE DRAWINGS

The single FIGURE of the drawing shows a dipole satellite antenna which is fitted into the fuse tip of a projectile.

DETAILED DESCRIPTION OF A PREFERRED EMBODIMENT

The munition article diagrammatically shown in the drawing is the tip 10 of a replaceable fuse tip 11 of an artillery projectile under a ballistic cap 12. The drawing does not show in greater detail mechanical assembly devices, impact sensor and firing transfer device with safety devices.

Mounted at the front end in the tip 10 is a free-standing dipole 13 which functions as an antenna for receiving items of satellite navigation information for controlling the course of the projectile, in such a way that the dipole axis coincides concentrically with the longitudinal axis 14 of projectile and thus ensures an omnidirectional characteristic. The dipole 13 is preferably tuned to the frequency range of GPS-frequencies. In order to reduce the dimension of the dipole 13 which is predetermined by virtue of the frequencies wanted, the dipole 13 is provided with top-loading capacitances of electrically conductive material. The current absorption thereof causes a virtual increase in length of the actual dipole. Those capacitances can be formed for example from metal surfaces or wires which are connected at least at one end at an angle to the dipole axis to the dipole 13. In that case, the angles between the conductor portions 15 and the dipole axis at the lower and upper ends of the dipole 13 can be both equal and also different, as shown in the drawing. The angle at the upper end of the dipole 13 is preferably so selected that the dipole 13 can be fitted with the conductor portions 15 into the fuse tip 11. The individual conductor portions 15 are so mounted to the dipole 13 that they are arranged rotationally symmetrically about the longitudinal axis 14 of the projectile. The conductor portions 15 can be meander-shaped as indicated at 16 and in that way the electrical path length of the short conductor portions can be increased. This preferred embodiment is illustrated in the drawing by way of example in relation to a conductor portion 16, representatively for all conductor portions 15. The dipole 13 is provided with two contact locations 17, from each of which a respective signal line 18 leads to the electronic signal-processing system (not shown).

The characteristic of the dipole arrangement can be influenced and set in accordance with the requirements involved, by virtue of the arrangement of a plurality of dipoles 13 which are combined in the form of an array.

The ballistic cap 12 comprises electrically non-conducting material, for example plastic material. At its inside, the ballistic cap 12 has openings or recesses 19 which correspond in respect of dimensions and arrangement to the ends of the dipole 13 and the conductor portions 15 mounted to the dipole 13. The dipole 13 and the conductor portions 15 are at least partially positively lockingly fitted into the openings or recesses 19.

In another embodiment the dipole 13 is enclosed in dielectric material and thus, in spite of the smaller geometry, the frequency range corresponding to the GPS-frequencies is guaranteed.

Thus in accordance with the invention, a munition article, the fuse tip 11 of the projectile, is provided with a dipole satellite antenna which faces in the direction of flight and which, by virtue of its characteristic which is uniform all around, permits interference-free reception of items of satellite navigation information, even if in the manner of an artillery projectile it is fired with spin along an elongate ballistic trajectory. Connected to the dipole 13 which is arranged concentrically with respect to the longitudinal axis 14 of the projectile are conductor portions 15 which are arranged rotationally symmetrically and which are disposed in a close fit in openings or recesses 19 in the ballistic cap 12.

What is claimed is:

1. A munition article with a satellite antenna, characterised in that an exposed dipole antenna (13) in the shape of an elongated rod member is arranged in the fuse tip (11) of a projectile under a ballastic cap (12) in such a way that the dipole axis of said rod member coincides concentrically with the longitudinal axis (14) of the projectile.

2. A munition article according to claim 1 characterised in that the dipole (13) is tuned to the frequency range of GPS-frequencies.

3. A munition article according to claim 1 characterised in that the dipole (13) is provided with top-loading capacitances of electrically conducting material which are connected in the form of conductor portions (15) at least at one end at an angle relative to the dipole axis to the dipole (13).

4. A munition article according to claim 3 characterised in that the conductor portions (15) are arranged rotationally symmetrically about the longitudinal axis (14) of the projectile.

5. A munition article according to claim 4 characterised in that conductor portions (15) are of a meander-shaped configuration (16).

6. A munition article according to claim 1 characterised in that at its inside the ballistic cap (12) has recesses (19) into which the dipole (13) is at least partially positively lockingly fitted.

7. A munition article according to claim 6 characterised in that the ballistic cap (12) comprises electrically non-conducting material.

8. A munition article according to claim 1 characterised in that the dipole (13) is enclosed in dielectric material.

* * * * *